US009514866B2

(12) United States Patent
Huang et al.

(10) Patent No.: US 9,514,866 B2
(45) Date of Patent: Dec. 6, 2016

(54) TOUCH-TYPE VARIABLE RESISTOR STRUCTURE

(71) Applicant: TAIWAN ALPHA ELECTRONIC CO., LTD., Taoyuan County (TW)

(72) Inventors: Tzu-Hsuan Huang, Taoyuan County (TW); Wei-Liang Liu, Taoyuan County (TW); Hsin-Tsun Tsai, Taoyuan County (TW)

(73) Assignee: Taiwan Alpha Electronic Co., Ltd., Taoyuan (TW)

( * ) Notice: Subject to any disclaimer, the term of this patent is extended or adjusted under 35 U.S.C. 154(b) by 0 days.

(21) Appl. No.: 14/837,237

(22) Filed: Aug. 27, 2015

(65) Prior Publication Data

US 2016/0247611 A1 Aug. 25, 2016

(30) Foreign Application Priority Data

Feb. 25, 2015 (TW) ..... 104202926 U

(51) Int. Cl.
*H01C 10/12* (2006.01)
*H01C 10/10* (2006.01)
*H01C 1/14* (2006.01)

(52) U.S. Cl.
CPC ..... *H01C 10/10* (2013.01); *H01C 1/14* (2013.01)

(58) Field of Classification Search
CPC ..... H01C 1/14; H01C 10/10
USPC ..... 338/114
See application file for complete search history.

(56) References Cited

U.S. PATENT DOCUMENTS 4,243,969 A * 1/1981 Steigerwald ..... H01C 10/04 338/138
4,651,123 A * 3/1987 Zepp ..... H01C 10/38 338/154
5,554,965 A * 9/1996 Sundberg ..... H01C 10/38 338/154
5,876,106 A * 3/1999 Kordecki ..... G01D 5/165 200/314
5,945,929 A * 8/1999 Westra ..... H01H 13/702 338/114
6,369,690 B1 * 4/2002 Chen ..... H01C 10/30 338/160
6,518,873 B1 * 2/2003 O'Regan ..... G01F 23/36 338/162
7,541,911 B2 * 6/2009 Kawaguchi ..... G01F 23/36 338/162

* cited by examiner

*Primary Examiner* — Kyung Lee
(74) *Attorney, Agent, or Firm* — Rosenberg, Klein & Lee

(57) ABSTRACT

A touch-type variable resistor structure includes a resistor-base plate, a conductive base plate and a separator member. The resistor-base plate further includes a main plate body and a resistance layer. The resistance layer extended along an extension direction is located on the main plate body. The conductive base plate located on the resistor-base plate includes an electricity-conductive layer facing the resistor-base plate. The separator member located between the resistor-base plate and the conductive base plate further has a central opening. One of the main plate body and the main conductive plate body is formed as a flexible-touch base plate. While the flexible-touch base plate is depressed, part of the electricity-conductive layer would pass through the central opening to electrically couple the resistance layer.

9 Claims, 12 Drawing Sheets

TOUCH-TYPE VARIABLE RESISTOR STRUCTURE

This application claims the benefit of Taiwan Patent Application Serial No. 104202926, filed Feb. 25, 2015, the subject matter of which is incorporated herein by reference.

BACKGROUND OF INVENTION

1. Field of the Invention

The invention relates to a touch-type variable resistor structure, and more particularly to a touch-type resistor structure that utilizes a depression operation to electrically couple an electricity-conductive layer to a resistance layer through a central opening of a separator member.

2. Description of the Prior Art

Generally speaking, current variable resistor related apparatus is mainly consisted of a circuit board having a resistance layer and a resistance-adjusting assembly having a conductive brush, such that a user can adjust the signal output pattern by varying the contact position between the conductive brush and the resistance layer, such that an option to vary the resistance by sliding the resistance-adjusting assembly can be provided to the user.

Refer now to FIG. 1 and FIG. 2; in which FIG. 1 is a schematic perspective view of a conventional slip-type variable resistor, and FIG. 2 is an exploded view of FIG. 1. As shown, the conventional slip-type variable resistor PA100 includes a housing PA1 and a resistance-adjusting assembly PA2.

The housing PA1 includes a base plate PA11, two electric conductive circuits PA12, two resistance circuits PA13 and an upper cover PA14. Each of the electric conductive circuits PA12 and each of the resistance circuits PA13 are both extended along the same extension direction L on the base plate PA11. Also, the resistance circuits PA13 and the electric conductive circuits PA12 are arranged on the base plate PA11 in a predetermined interval manner. The upper cover PA14 as shown has a restraint slot PA141 and six fixation legs PA142. The restraint slot PA141 is also extended along the extension direction L. Each of the fixation legs PA142 is bent so as to buckle the base plate PA11. Upon such an arrangement, the upper cover PA14 can be fixedly engaged with the base plate PA11.

The resistance-adjusting assembly PA2 further includes a sliding structure PA21, a conductive contact plate PA22, a handle PA23, a spring plate PA24 and a spacer plate PA25. The sliding structure PA21 is movable in the extension direction L, and is located on the base plate PA11. The conductive contact plate PA22 is riveted to fix the sliding structure PA21, and is electrically communicative to the electric conductive circuits PA12 and the resistance circuits PA13. The handle PA23 is fixed above to the sliding structure PA21 by protruding outside through the restraint slot PA141, such that the user can operate the handle PA23 to control back-and-forth movement of the resistance-adjusting assembly PA2 along the extension direction L.

The spring plate PA24 is to sleeve the handle PA23 by contacting the sliding structure PA21, and the spacer plate PA25 is further to sleeve the handle PA23 by locating at a position between the spring plate PA24 and the upper cover PA14, so as to reduce the friction forcing while in moving the resistance-adjusting assembly PA2.

As described above, the resistance-adjusting assembly PA2 is located between the housing PA1 and the upper cover PA14, so as to be restrained by the upper cover PA14 by limiting the handle PA23 able to be moved only in the restraint slot PA141 along the extension direction L. However, in such a restraint displacement of the handle PA23, since the exact contact point of the conductive contact plate PA22 at the electric conductive circuit PA12 or the resistance circuit PA13 would vary slightly time by time, the induced resistance value would be also affected according to the contact point at the resistance circuit PA13. Definitely, the resulted output signal for the contacting would be different.

Nevertheless the conventional variable resistor may allow the user to make some slight structural changes to calibrate the output signals, yet, since the conventional variable resistor mainly includes the resistance-adjusting assembly consisted of the handle, the sliding structure, and other mechanical parts, the resulted variable resistor would inevitably occupy substantial space for the resistance-adjusting assembly to be manipulated. In addition, the resulted operational sensitivity would also be limited.

Further, since a conventional variable resistor can only furnish an output signal, so while multiple output signals are necessary, it is required to prepare at the same time a plurality of variable resistors accounting to these output signals.

SUMMARY OF THE INVENTION

As stated above, in the art, the conventional variable resistor would inevitably occupy a substantial room, and the operational sensitivity is limited. In addition, since the conventional variable resistor can only provide single mode usage for the user to generate a single output signal, so, accordingly, it is the primary object of the present invention to provide a touch-type variable resistor structure that can reduce the space occupation effectively, provide the user a more sensitive operational performance, and perform a dual touch-mode operation upon the flexible-touch base plate for producing simultaneously two sets of output signals.

In the present invention, the touch-type variable resistor structure includes a resistor-base plate, a conductive base plate and at least one separator member. The resistor-base plate further includes a main plate body and two resistance layers. The two resistance layers extended along an extension direction are arranged separately on the main plate body. The two resistance layers include a first resistance layer and a second resistance layer. The first resistance layer has a positive end and a negative end, and the second resistance layer also has its-own a positive end and a negative end, the positive end of the first resistance layer and the negative end of the second resistance layer being located at one side of the main plate body, the negative end of the first resistance layer and the positive end of the second resistance layer being located at another side of the main plate body.

The conductive base plate located on the resistor-base plate further includes a main conductive plate body and an electricity-conductive layer. The main conductive plate body has a coupling surface facing the two resistance layers of the resistor-base plate. The electricity-conductive layer extended along the extension direction is located on the coupling surface and s able to shadow the two resistance layers. The separator member located between the resistor-base plate and the conductive base plate further has a central slot-type opening by corresponding to the two resistance layers and the electricity-conductive layer. One of the main plate body and the main conductive plate body is a flexible-touch base plate. While the flexible-touch base plate is depressed, part of the electricity-conductive layer would pass through the central slot-type opening to electrically couple the two resistance layers.

In the present invention, the touch-type variable resistor structure can provide the user to connect the electricity-conductive layer and the two resistance layers by depressing the flexible-touch base plate. Since the positive end and the negative end of the two resistance layers are reversely arranged, thus two voltage differences would be generated while a single-point depression upon the flexible-touch base plate is performed to couple electrically the electricity-conductive layer and the two resistance layers simultaneously. Hence, a mono or single touch-mode operation of the present invention is complete.

On the other hand, while a dual touch-mode operation of the present invention is performed upon the flexible-touch base plate, two different current paths for the two resistance layers would be formed so as to produce two different voltage differences. Since the positive ends and the negative ends of the two resistance layers are reversely arranged, hence a user can apply his/her own two fingers to perform the dual touch-mode operation, so as to produce two different voltage differences.

In one embodiment of the present invention, the resistor-base plate further includes two electrode sets, the first resistance layer and the second resistance layer being electrically coupled to the two electrode sets, respectively.

In one embodiment of the present invention, the two resistance layers are both carbon coating layers.

In one embodiment of the present invention, the separator member is an insulated annular plate.

In one embodiment of the present invention, the electricity-conductive layer is made of an electricity-conductive metallic material.

In another aspect of the present invention, the touch-type variable resistor structure includes a resistor-base plate, a conductive base plate and a separator member. The resistor-base plate includes a main plate body, at least one resistance layer and a plurality of detection circuit layers. The resistance layer located on the main plate body is extended along an extension direction. The plurality of detection circuit layers are arranged on the main plate body in a predetermined interval manner. The plurality of detection circuit layers are all electrically coupled to the resistance layer. The conductive base plate located on the resistor-base plate further includes a main conductive plate body and an electricity-conductive layer. The main conductive plate body has a coupling surface facing the main plate body. The electricity-conductive layer located on the coupling surface is extended along the extension direction and provides a coverage area to shadow the plurality of detection circuit layers. The separator member located between the resistor-base plate and the conductive base plate is to separate the plurality of detection circuit layers from the electricity-conductive layer. The separator member further includes a central opening extending along the extension direction. The plurality of detection circuit layers and the electricity-conductive layer are located in correspondence with the central opening. In the present invention, one of the main plate body and the main conductive plate body is a flexible-touch base plate for enabling part of the electricity-conductive layer to protrude through the central opening while in meeting a depression so as to have the electricity-conductive layer to contact simultaneously the two resistance layers.

In the present invention, the touch-type variable resistor structure can provide the user to electrically connect the electricity-conductive layer and the detection circuit layers by simply depressing the flexible-touch base plate. Since the positive end and the negative end of the two resistance layers are reversely arranged, thus two voltage differences would be generated while a single-point depression upon the flexible-touch base plate is performed to couple electrically the electricity-conductive layer and the two resistance layers simultaneously. In addition, while a dual touch-mode operation is performed upon the flexible-touch base plate, two different current paths for the two resistance layers would be formed so as to produce two different voltage differences. In addition, with the help of the arrangement of the detection circuit layer along the extension direction, the effective area for depressing the flexible-touch base plate can be enlarged. Namely, the effective area of the depression is mainly dependent to the length of the detection circuit layer and the corresponding arrangement, and so the present invention can successfully enhance the control convenience to various users.

In one embodiment of the present invention, the plurality of detection circuit layers is expanded in an extension direction of detection circuit perpendicular to the extension direction.

In one embodiment of the present invention, the resistance layer is formed as a pair of resistance layers, the two resistance layer being separated, the plurality of detection circuit layers further including a plurality of first detection circuit layers and a plurality of second detection circuit layers, the plurality of first detection circuit layers being electrically coupled to a first resistance layer of the two resistance layers, the plurality of second detection circuit layers being electrically coupled to a second resistance layer of the two resistance layers, the plurality of first detection circuits and the plurality of second detection circuits being arranged in a predetermined interval manner, the resistance layer is formed as a pair of resistance layers, the two resistance layer being separated, the plurality of detection circuit layers further including a plurality of first detection circuit layers and a plurality of second detection circuit layers, the plurality of first detection circuit layers being electrically coupled to a first resistance layer of the two resistance layers, the plurality of second detection circuit layers being electrically coupled to a second resistance layer of the two resistance layers, the plurality of first detection circuits and the plurality of second detection circuits being arranged in a predetermined interval manner. Preferably, the first resistance layer has a positive end and a negative end, and the second resistance layer also has its-own a positive end and a negative end, the positive end of the first resistance layer and the negative end of the second resistance layer being located at one side of the main plate body, the negative end of the first resistance layer and the positive end of the second resistance layer being located at another side of the main plate body.

In one embodiment of the present invention, the resistor-base plate further includes at least one electrode set, the electrode set having a positive contact point and a negative contact point, the resistance layer having two ends to electrically couple the positive contact point and the negative contact point, respectively.

In one embodiment of the present invention, the resistance layer is a carbon coating layer.

All these objects are achieved by the touch-type variable resistor structure described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a touch-type variable resistor structure. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
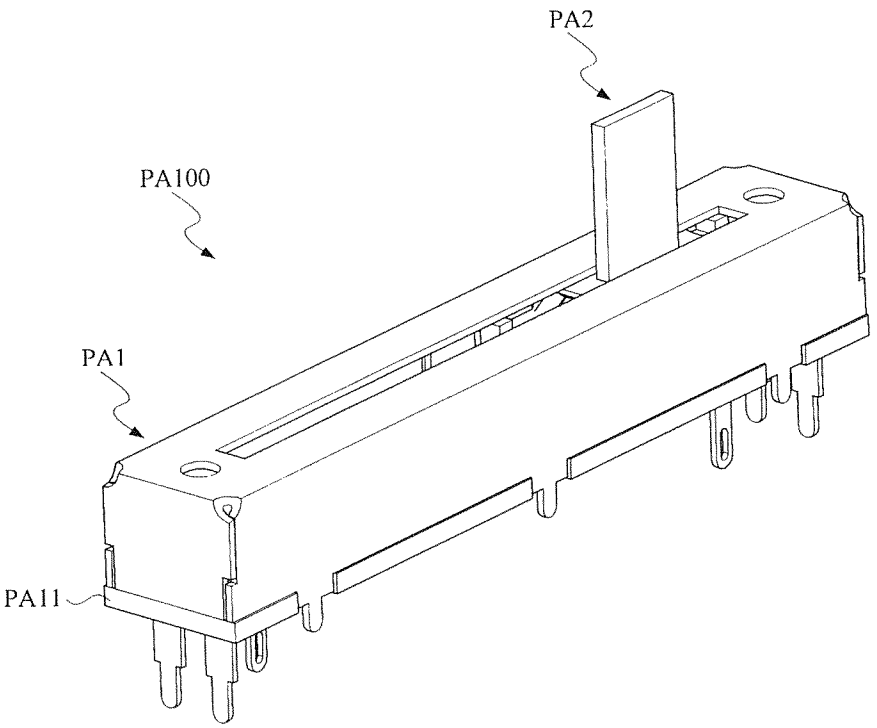
FIG.1(Prior Art)
FIG. 1 is a schematic perspective view of a conventional slip-type variable resistor.
Figure 2:
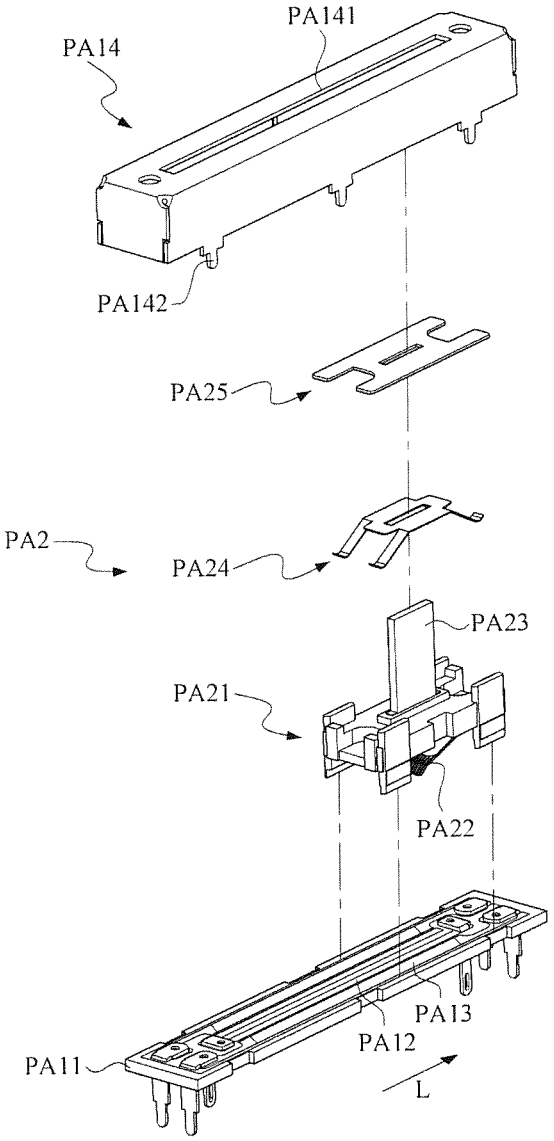
FIG.2(Prior Art)
FIG. 2 is an exploded view of FIG. 1.
Figure 3:
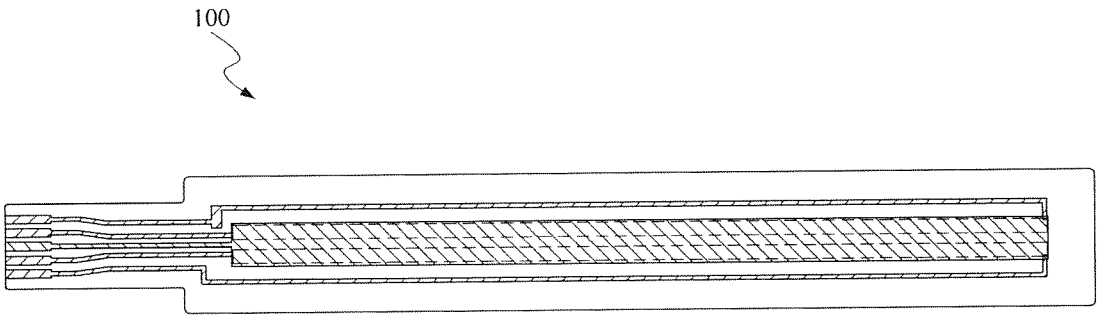
FIG. 3 is a schematic planar view of a first embodiment of the touch-type variable resistor structure in accordance with the present invention.
Figure 4:
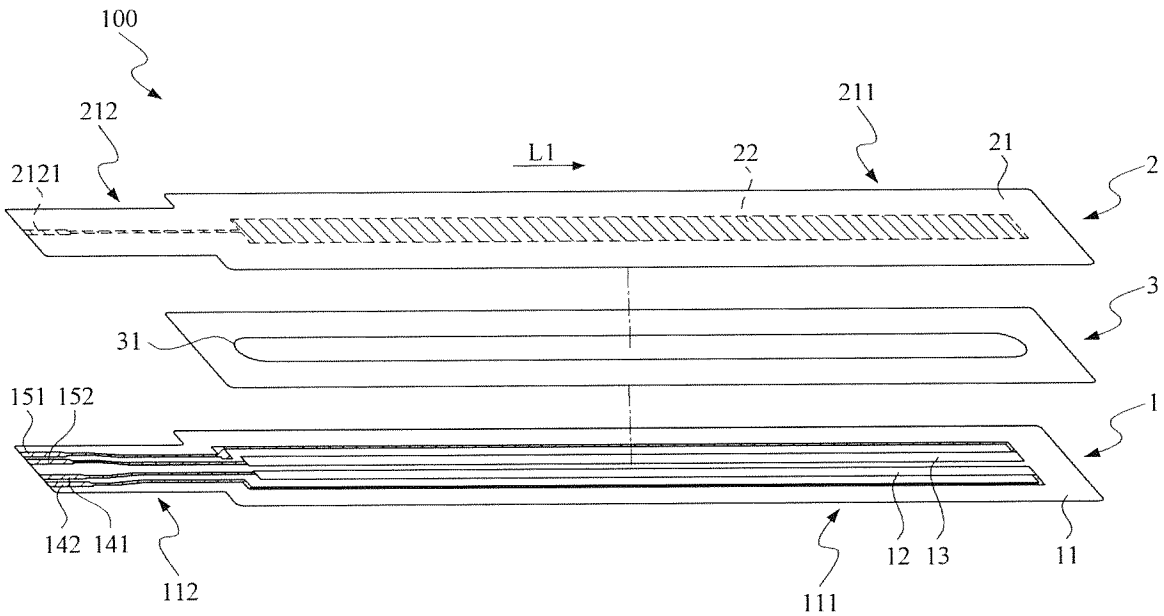
FIG. 4 is an exploded view of FIG. 3.
Figure 5:
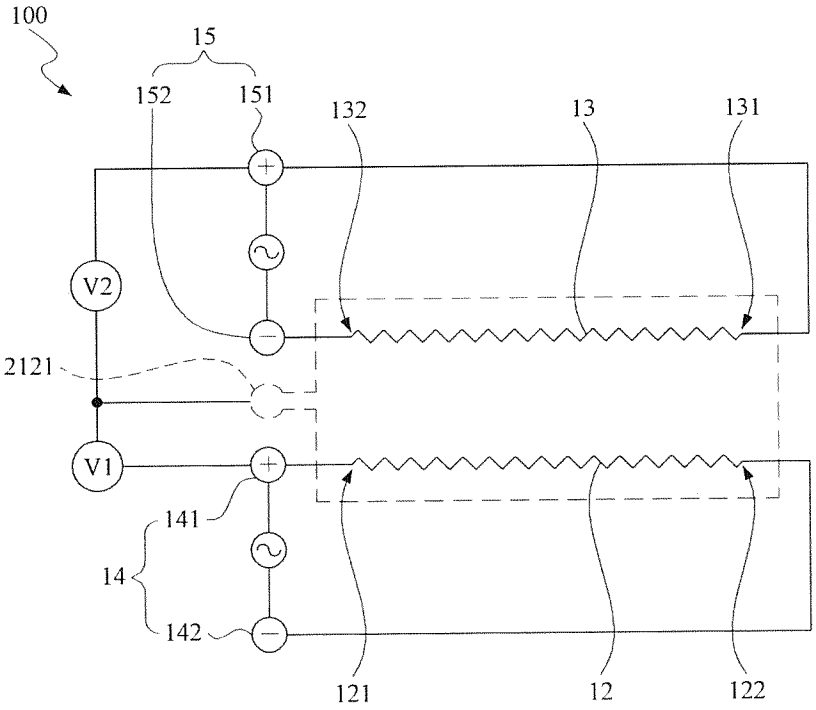
FIG. 5 is a schematic view of a circuitry showing an electric coupling of the aforesaid first embodiment of the touch-type variable resistor structure and voltage detection elements.

Refer now to FIG. 3 through FIG. 5; in which FIG. 3 is a schematic planar view of a first embodiment of the touch-type variable resistor structure in accordance with the present invention, FIG. 4 is an exploded view of FIG. 3, and FIG. 5 is a schematic view of a circuitry showing an electric coupling of the aforesaid first embodiment of the touch-type variable resistor structure and voltage detection elements.

As shown in FIG. 4, the touch-type variable resistor structure 100 of the present invention includes a resistor-base plate 1, a conductive base plate 2 and a separator member 3.

The resistor-base plate 1 includes a main plate body 11, two resistance layers (a first resistance layer 12 and a second resistance layer 13) and two electrode sets (a first electrode set 14 and a second electrode set 15).

The main plate body 11 has a touch portion 111 and a wiring portion 112. The wiring portion 112 originated from the touch portion 111 is extended along a negative direction of the extension direction L1.

The first resistance layer 12 and the second resistance layer 13 are both extended along the extension direction L1, and are arranged on the main plate body 11 in a predetermined interval manner. Individual resistance values or for the first resistance layer 12 and the second resistance layer 13 can be the same or non-identical. In this embodiment, the extension direction L1 is, but not limited to, a linear direction. In some other embodiments, the extension direction can be an arc direction.

The first resistance layer 12 has a positive end 121 and an opposing negative end 122, while the second resistance layer 13 has an its-own positive end 131 and also an opposing negative end 132. The positive end 121 of the first resistance layer 12 and the negative end 132 of the second resistance layer 13 are located at the same side, while the negative end 122 of the first resistance layer 12 and the positive end 131 of the second resistance layer 13 are located at another same side. In this embodiment, the two resistance layers are both carbon coating layers.

The first electrode set 14 and the second electrode set 15 are both located at the same side of the wiring portion 112. The first electrode set 14 includes a first positive terminal 141 and a first negative terminal 142, in which the positive end 121 of the first resistance layer 12 is electrically coupled to the first positive terminal 141 and the negative end 122 of the first resistance layer 12 is electrically coupled to the first negative terminal 142.

The second electrode set 15 includes a second positive terminal 151 and a second negative terminal 152, in which the positive end 131 of the second resistance layer 13 is electrically coupled to the second positive terminal 151 and the negative end 132 of the second resistance layer 13 is electrically coupled to the second negative terminal 152.

The conductive base plate 2 is located on the resistor-base plate 1, and the conductive base plate 2 further includes a main conductive plate body 21 and an electricity-conductive layer 22.

The main conductive plate body 21 has an electricity-conductive portion 211 and an output portion 212. The electricity-conductive portion 211 further has a coupling surface (not shown in the figure) facing the main plate body 11. The output portion 212 is protruded from the electricity-conductive portion 211 by extending along the negative direction of the extension direction L1, and further has an output terminal 2121.

The electricity-conductive layer 22 is extended along the extension direction L1 on the coupling surface to the electrode contact point 2121 by providing a cover surface to shadow respectively the first resistance layer 12 and the second resistance layer 13. In this embodiment, the electricity-conductive layer 22 is made of an electricity-conductive metallic material, selected from the group of at least the gold, the silver, the copper, the tin and any metal with a high electric conductivity. As shown in FIG. 3, a transparent view has been applied to elucidate the spatial coverage relationship among the electricity-conductive layer 22, the first resistance layers 12 and the second resistance layers 13.

The separator member 3 is located between the resistor-base plate 1 and the conductive base plate 2, and further has a central slot-type opening 31. The central slot-type opening 31 is extended in a manner to account for the two resistance layers (the first resistance layer 12 and the second resistance layer 13) and the electricity-conductive layer 22. In the present embodiment, the separator member 3 is formed to be an insulated annular plate, as a flexible or hard insulated annular plate. In some other embodiments, the separator member 3 is consisted of a plurality of insulation elements for forming thereinside the central slot-type opening.

In addition, one of the main plate body 11 and the main conductive plate body 21 shall be a flexible-touch base plate. In this embodiment, the main conductive plate body 21 is to act as the flexible-touch base plate. When the flexible-touch base plate (i.e. the main conductive plate body 21 in this embodiment) is depressed down to protrude through the central slot-type opening 31, the electricity-conductive layer 22 would suddenly touch the first resistance layer 12 and the second resistance layer 13. In some other embodiments, the main plate body 11 can act as the flexible-touch base plate.

Figure 6:
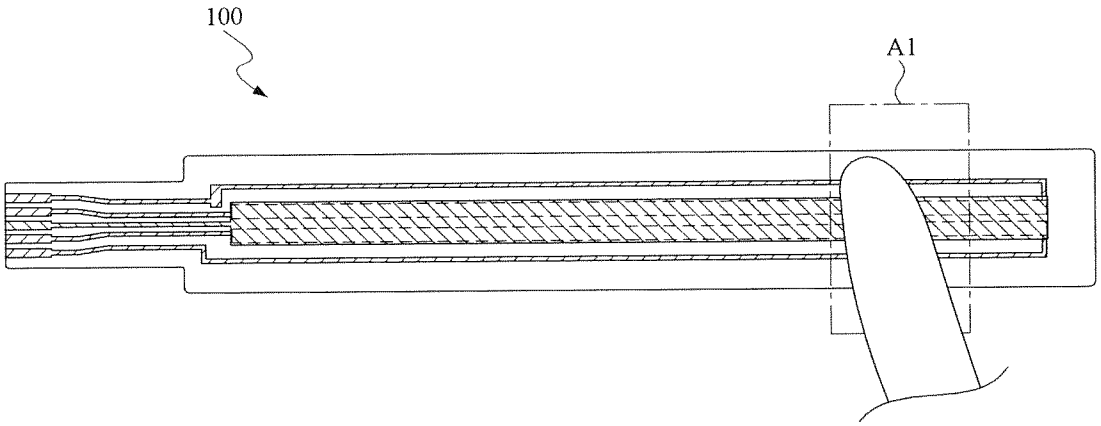
FIG. 6 demonstrates a single-finger touch upon the aforesaid first embodiment of the touch-type variable resistor structure of FIG. 5.
Figure 7:
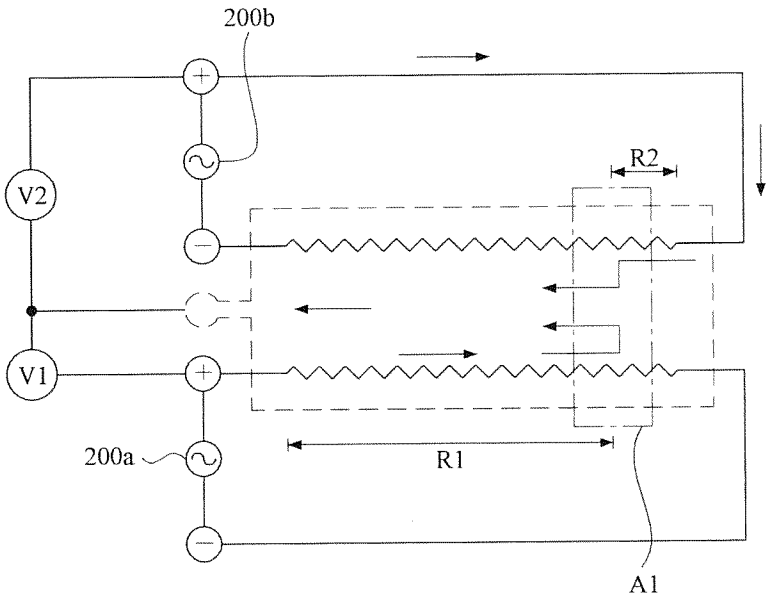
FIG. 7 demonstrates a schematic view of the circuitry related to FIG. 6.

Refer now to FIG. 5, FIG. 6 and FIG. 7; in which FIG. 6 demonstrates a single-finger touch upon the aforesaid first embodiment of the touch-type variable resistor structure of FIG. 5, and FIG. 7 demonstrates a schematic view of the circuitry related to FIG. 6.

As shown, the first positive terminal 141 and the first negative terminal 142 are both electrically coupled to a power source 200*a*, while the second positive terminal 151 and the second negative terminal 152 are electrically coupled to another power source 200*b*. A first voltage detection element V1 is located between the electrode contact point 221 and the first positive terminal 141, and a second voltage detection element V2 is located between the electrode contact point 221 and the second positive terminal 151. In this embodiment, the output voltages for the power source 200*a* and the power source 200*b* are the same. However, in some other embodiments, the positive end of one power sources can be connected to both the first positive terminal 141 and the second positive terminal 151, while the negative end of the same power source is connected to the first negative terminal 142 and also the second negative terminal 152.

While the user applies one of his/her fingers to depress the main conductive plate body 21, the electricity-conductive layer 22 within a first depression area A1 corresponding to the finger touch would protrude down through the central slot-type opening 31 so as to make contact with the first resistance layer 12 and the second resistance layer 13, such that the first voltage detection element V1 would detect a voltage difference across the resistance section R1 and further generate a first voltage difference signal. At the same time, the second voltage detection element V2 would detect another voltage difference across another resistance section R2 and further to generate a second voltage difference signal. In practice, the first voltage detection element V1 and the second voltage detection element V2 are connected with a processing module that would generate the required touch signals according to the first voltage difference signal and the second voltage difference signal.

Figure 8:
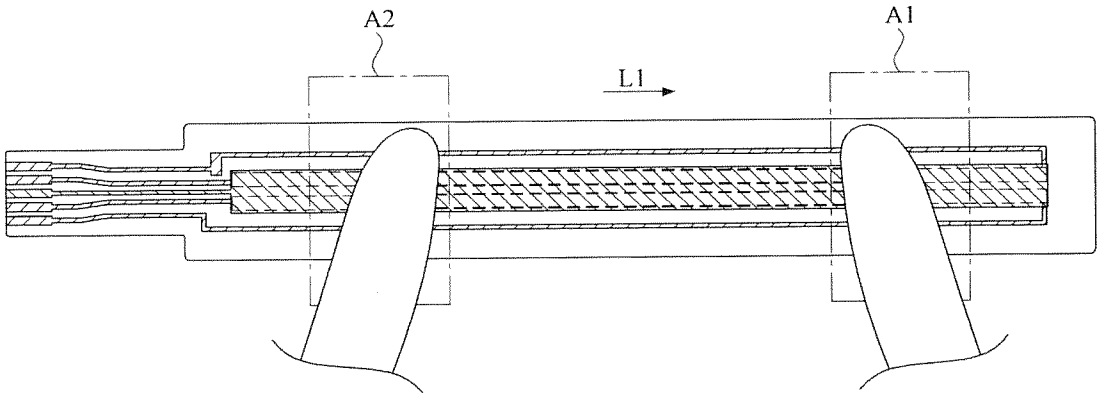
FIG. 8 demonstrates a two-finger touch upon the aforesaid first embodiment of the touch-type variable resistor structure of FIG. 5.
Figure 9:
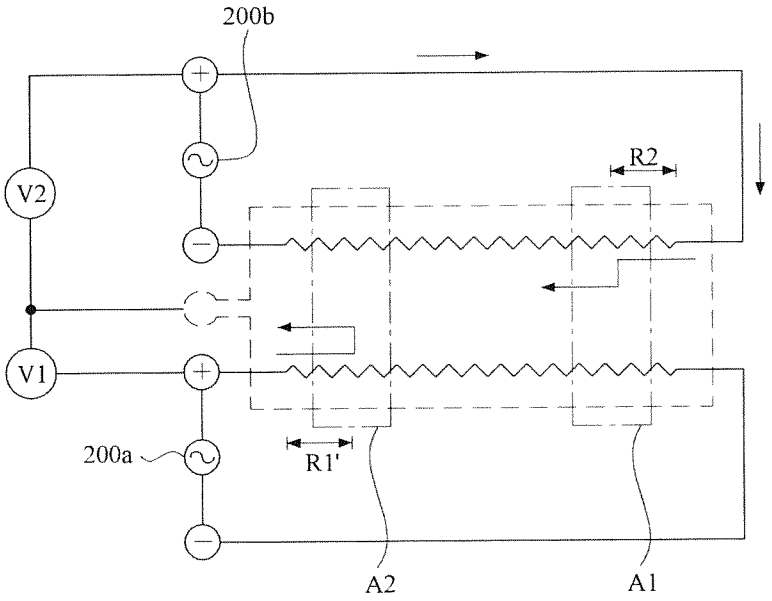
FIG. 9 demonstrates a schematic view of the circuitry related to FIG. 8.

Refer now to FIG. 5, FIG. 8 and FIG. 9; in which FIG. 8 demonstrates a two-finger touch upon the aforesaid first embodiment of the touch-type variable resistor structure of FIG. 5, and FIG. 9 demonstrates a schematic view of the circuitry related to FIG. 8.

As shown, while the user applies two of his/her fingers to depress the main conductive plate body 21, the electricity-conductive layer 22 within a first depression area A1 corresponding to one finger touch and a second depression area A2 corresponding to another finger touch would protrude down, in a dual-cavity manner, through the central slot-type opening 31 so as to make contact simultaneously with the first resistance layer 12 and the second resistance layer 13, such that a current of the power source 200*a* would flow through the electricity-conductive layer 22 within the second depression area A2 (via a resulted shorter resistance path) so as to establish an electric connection to the first voltage detection element V1 for the first voltage detection element V1 to detect a voltage difference across a resistance section R1 and further to generate a corresponding first voltage difference signal. Similarly and simultaneously, a current of the power source 200*b* would flow through the electricity-conductive layer 22 within the first depression area A1 (via a resulted shorter resistance path) so as to establish an electric connection to the second voltage detection element V2 for the second voltage detection element V2 to detect another voltage difference across another resistance section R1 and further to generate a corresponding second voltage difference signal. Further, the processing module connected with both the first voltage detection element V1 and the second voltage detection element V2 would generate two corresponding touch signals, accordingly. In addition, when the user moves one of the first depression area A1 and the second depression area A2 along the extension direction L1, the corresponding touch signal would change accordingly, with another touch signal unchanged.

Figure 10:
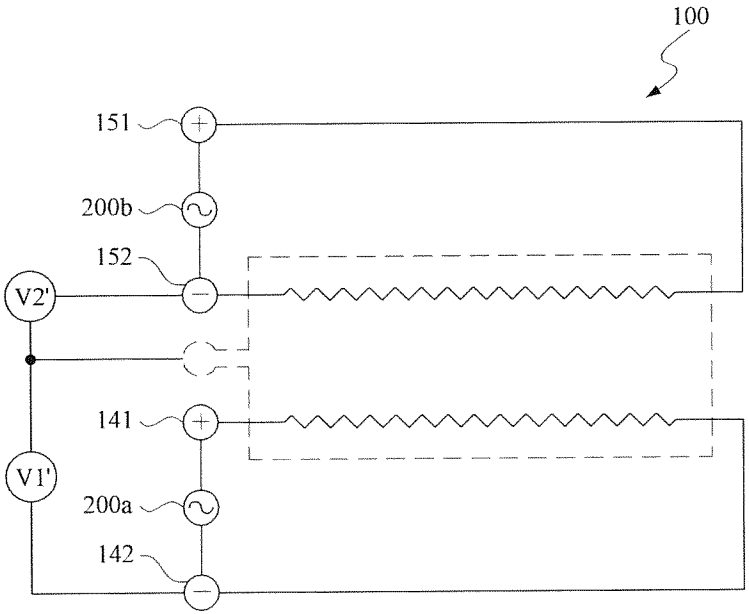
FIG. 10 is a schematic view of a circuitry showing another electric coupling of the aforesaid first embodiment of the touch-type variable resistor structure and voltage detection elements.

Refer now to FIG. 10, in which a schematic view of a circuitry showing another electric coupling of the aforesaid first embodiment of the touch-type variable resistor structure and voltage detection elements is shown.

As shown, by comparing with the connection pattern for the aforesaid first positive terminal 141 and the aforesaid second positive terminal 151 to electrically couple with the first voltage detection element V1 and the second voltage detection element V2, respectively, the touch-type variable resistor structure 100 of the present invention can also be constructed by having the first negative terminal 142 and the second negative terminal 152 to electrically couple a first voltage detection element V1' and a second voltage detection element V2', respectively, as shown in FIG. 10. It shall be noted that the design concept of FIG. 10 is almost the same as the previous one that connects the first positive terminal 141 and the second positive terminal 151 respectively to the first voltage detection element V1 and the second voltage detection element V2, with only a difference that the current paths across the first voltage detection element V1 and the second voltage detection element VT are totally reversed.

In the aforesaid first embodiment of the present invention, the touch-type variable resistor structure uses a separator member to separate the resistor-base plate and the conductive base plate. By comparing with the conventional variable resistor structure as stated in the background section, the touch-type variable resistor structure of the present invention can effectively provide the user to use one or two fingers to perform the touch operation so as to generate two touch signals. While in a dual-finger touch operation with a motionless contact point and a moving contact point, a fixed-value touch signal and a varying-value touch signal would be generated simultaneously, such that detection sensibility can be substantially enhanced. Furthermore, a more-advanced and more versatile mode with two moving contact points can also be operated in accordance with the aforesaid teaching so as to generate two varying-value contact signals.

Furthermore, since the touch-type variable resistor structure of the present invention enables the user to depress the flexible-touch base plate so as to protrude the electricity-conductive layer to contact simultaneously the first resistance layer and the second resistance layer, and also since the positive end of the first resistance layer and the negative end of the first resistance layer can present an opposite construction with respect to the positive end of the second resistance layer and the negative end of the second resistance layer, so, while the user applies one finger to depress the flexible-touch base plate so as to push the electricity-conductive layer to contact simultaneously the said two resistance layers, two voltage differences would occur to generate accordingly two different touch signals. Also, when the use applies two fingers to perform the depression, two voltage differences may also occur to generate two different touch signals accordingly. In practice, the user can utilize the touch-type variable resistor structure of the present invention to generate two sets of voltage difference signals, and may observe real changes of the voltage difference signals by moving the contact points, such that the operation controllability can be substantially enhanced.

Figure 11:
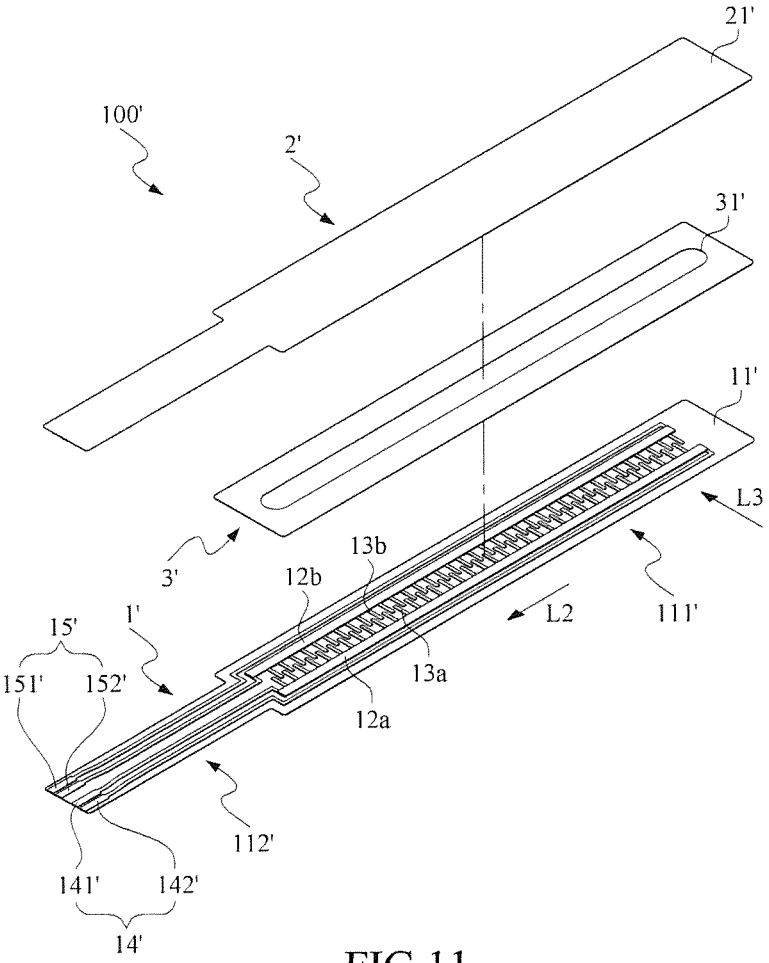
FIG. 11 is a schematic exploded view of a second embodiment of the touch-type variable resistor structure in accordance with the present invention.
Figure 12:
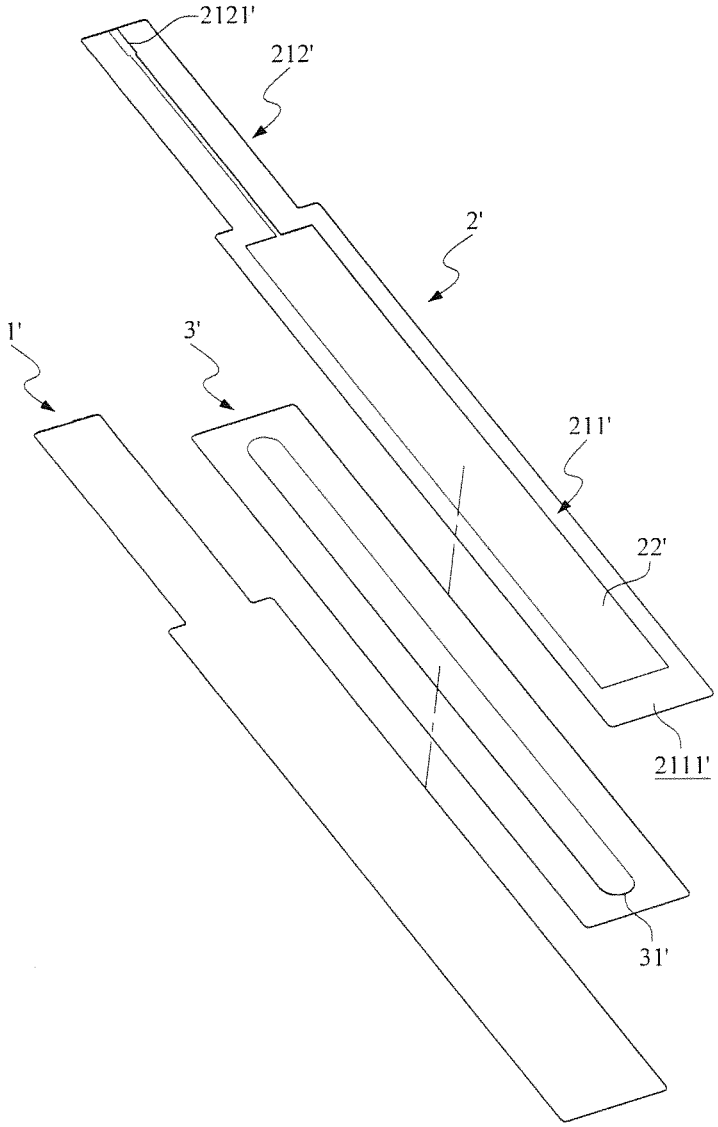
FIG. 12 is another view of FIG. 11.

Refer now to FIG. 11 and FIG. 12; in which FIG. 11 is a schematic exploded view of a second embodiment of the touch-type variable resistor structure in accordance with the present invention, and FIG. 12 is another view of FIG. 11.

As shown, the touch-type variable resistor structure 100' includes a resistor-base plate 1', a conductive base plate 2' and a separator member 3'.

The resistor-base plate 1' includes a main plate body 11', two first resistance layer 12*a* and 12*b*, a plurality of first detection circuit layers 13*a* and 13*b*, a first electrode set 14' and a second electrode set 15'. The main plate body 11' has a touch portion 111' and a wiring portion 112', in which the wiring portion 112' is extended along a extension direction L2 from the touch portion 111'.

The first resistance layers 12*a* and the second resistance layers 12*b* are arranged in a predetermined interval manner on the touch portion 111' of the main plate body 11', and are all extended along the extension direction L2. The first resistance layer 12*a* has a positive end (not labeled in the figure) and a negative end (not labeled in the figure), and the second resistance layer 12*b* also has a positive end (not labeled in the figure) and a negative end. The positive end of the first resistance layer and the negative end of the second resistance layer are located at the same side of the main plate body 11', while the negative end of the first resistance layer and the positive end of the second resistance layer are located at another side of the main plate body 11'.

The first detection circuit layers 13*a* are extended parallel along the extension direction L2 on the touch portion 111' of the main plate body 11', and are located between the first resistance layer 12*a* and the second resistance layer 12*b*. The first detection circuit layers 13*a* are both electrically coupled to the first resistance layer 12*a*. Similarly, the second detection circuit layer 13*b* are extended parallel along the extension direction L2 on the touch portion 111' of the main plate body 11', and are located between the first resistance layer 12*a* and the second resistance layer 12*b*. are extended parallel along the extension direction L2 on the touch portion 111' of the main plate body 11', and are located between the first resistance layer 12*a* and the second resistance layer 12*b*. 且 second detection circuit layer 13*b* 皆 electrically coupled to 於 second resistance layer 12*b*. The first detection circuit layers 13*a* and 13*b* are constructed along the extension direction L2 in a predetermined distribution manner also by having the first detection circuit layers 13*a* and 13*b* to be expanded along an extension direction of the detection circuit L3 perpendicular to the extension direction L2.

The first electrode set 14' and the second electrode set 15' are located at one end of the wiring portion 112', and the first electrode set 14' includes a first positive terminal 141' and a first negative terminal 142'. The positive end of the first resistance layer is electrically coupled to the first positive terminal 141', and the negative end of the first resistance layer is electrically coupled to the first negative terminal 142. The second electrode set 15' includes a second positive terminal 151' and a second negative terminal 152', in which the positive end of the second resistance layer is electrically coupled to the second positive terminal 151' and the negative end of the second resistance layer is electrically coupled to the second negative terminal 152'.

The conductive base plate 2' is mounted on the resistor-base plate 1', and further includes a main conductive plate body 21' and an electricity-conductive layer 22'. The main conductive plate body 21' has an electricity-conductive portion 211' and an output portion 212'; in which the electricity-conductive portion 211' further has a coupling surface 2111' facing the main plate body 11', and the output portion 212' originated from the electricity-conductive portion 211' is extended along the extension direction L2. The output portion 212' further has an output terminal 2121'. The electricity-conductive layer 22' is extended along the extension direction L2 on the coupling surface 2111' to the output terminal 2121' of the output portion 212'. The electricity-conductive layer 22' provides a coverage area to shadow spatially the first detection circuit layers 13*a* and 13*b*. The electricity-conductive layer 22' is made of an electricity-conductive metallic material. In this embodiment, the electricity-conductive layer 22' is formed as a silver coating layer.

The separator member 3' is located between the resistor-base plate 1' and the conductive base plate 2' so as to separate the first detection circuit layers 13*a* and 13*b* from the electricity-conductive layer 22'. The separator member 3' includes an interior central opening 31' extended along the extension direction L2. The first detection circuit layers 13*a* and 13*b* and the electricity-conductive layer 22' are all located by corresponding to the central opening 31'.

In this embodiment, the main conductive plate body 21' is formed as a flexible-touch base plate, so that, while the main conductive plate body 21' is depressed, the electricity-conductive layer 22' can be pushed to partly protrude through the central opening 31' and further to electrically couple at least one of the first detection circuit layer 13*a* and the second detection circuit layer 13*b*. In some other embodiments, the main plate body 11' can also be the flexible-touch base plate, and thus the main plate body 11' can be depressed to protrude part of the electricity-conductive layer 22' to pass the central opening 31' and thereby to electrically couple at least one of the first detection circuit layer 13*a* and the second detection circuit layer 13*b*. In addition, the main plate body 11' and the main conductive plate body 21' can both be the flexible-touch base plates, but at one of them shall be supported by a hard backing plate.

As stated above, the present embodiment of the touch-type variable resistor structure 100' is basically similar to the aforesaid first embodiment 100, and the major difference in between is that this second embodiment 100' includes a plurality of first detection circuit layers 13*a* and 13*b* between the two resistance layers 12*a* and 12*b* and the first detection circuit layers 13*a* and 13*b* are intermittently arranged and electrically individually coupled to the corresponding resistance layers 12*a* and 12*b*. Upon such an arrangement, while the user depresses or touches the main conductive plate body 21' to further enable part of the electricity-conductive layer 22' to protrude through the central opening 31' and further to electrically couple the first detection circuit layer 13*a* or the second detection circuit layer 13*b*, electric connections can thus be established by having the electricity-conductive layer 22' to contact the first detection circuit layer 13*a* and the resistance layer 12*a*, or to contact the second detection circuit layer 13*b* and the resistance layer 12*b*. In addition, since the first detection circuit layer 13*a* is extended along the extension direction L2 and expanded along the extension direction of the detection circuit L3 perpendicular to the extension direction L2, and since the second detection circuit layer 13*b* is expanded in an opposite direction of the first detection circuit layer 13*a*, so, while the user pushes on the main conductive plate body 21' and slides along the extension direction L2 within the coverage of the central opening 31', the expansion of the first detection circuit layers 13*a* and 13*b* in the direction perpendicular to the extension direction L2 can greatly increase the contact area with the electricity-conductive layer 22', such that a broader effective area for touching and sliding can be obtained, and thus the operational sensitivity can be increased. In addition, circuitries for the second embodiment of the touch-type variable resistor structure 100' is largely the same as that for the first embodiment of the touch-type variable resistor structure 100, and thus details thereabout would be omitted herein.

In summary, by comparing with the conventional variable resistor, the touch-type variable resistor structure in accordance with the present invention uses a separator member to separate the resistor-base plate and the conductive base plate. By comparing with the conventional variable resistor structure as stated in the background section, the touch-type variable resistor structure of the present invention can effectively provide the user to use one or two fingers to perform the touch operation so as to generate two touch signals. While in a dual-finger touch operation with a motionless contact point and a moving contact point, a fixed-value touch signal and a varying-value touch signal would be generated simultaneously, such that detection sensibility can be substantially enhanced. Furthermore, a more-advanced and more versatile mode with two moving contact points can also be operated in accordance with the aforesaid teaching so as to generate two varying-value contact signals.

On the other hand, since the touch-type variable resistor structure of the present invention can provide a plurality of detection circuit layers with a predetermined arrangement for the user to depress the flexible-touch base plate and to further establish the electric connection between the electricity-conductive layer and the detection circuit layer, and thereby relevant voltage difference signals can be generated, so, with the help of the arrangement of the detection circuit layer along the extension direction, the effective area for depressing the flexible-touch base plate can be enlarged. Namely, the effective area of the depression is mainly dependent to the length of the detection circuit layer and the corresponding arrangement, and so the present invention can successfully enhance the control convenience to various users.

While the present invention has been particularly shown and described with reference to a preferred embodiment, it will be understood by those skilled in the art that various changes in form and detail may be without departing from the spirit and scope of the present invention.

What is claimed is:

1. A touch-type variable resistor structure, comprising:

a resistor-base plate, further including:

a main plate body; and two resistance layers, extended along an extension direction in a predetermined interval manner on the main plate body, the two resistance layers being formed as a first resistance layer and a second resistance layer, the first resistance layer having a positive end and a negative end, the second resistance layer also having its-own a positive end and a negative end, the positive end of the first resistance layer and the negative end of the second resistance layer being located at one side while the negative end of the first resistance layer and the positive end of the second resistance layer are located at another side;

a conductive base plate, located on the resistor-base plate, further including:

a main conductive plate body, having a coupling surface facing the two resistance layers of the resistor-base plate; and an electricity-conductive layer, extended along the extension direction on the coupling surface, a coverage area of the electricity-conductive layer being to shadow the two resistance layers; and at least one separator member, located between the resistor-base plate and the conductive base plat, further having a central opening located corresponding to the two resistance layer and the electricity-conductive layer;

wherein one of the main plate body and the main conductive plate body is a flexible-touch base plate for enabling part of the electricity-conductive layer to protrude through the central opening while in meeting a depression so as to have the electricity-conductive layer to contact simultaneously the two resistance layers.

2. The touch-type variable resistor structure of claim 1, wherein the resistor-base plate further includes two electrode sets, the first resistance layer and the second resistance layer being electrically coupled to the two electrode sets, respectively.

3. The touch-type variable resistor structure of claim 1, wherein the two resistance layers are both carbon coating layers.

4. A touch-type variable resistor structure, comprising:

a resistor-base plate, further including:

a main plate body;

at least one resistance layer, located on the main plate body and extending along an extension direction; and a plurality of detection circuit layers, located along the extension direction in a predetermined interval manner on the main plate body, the plurality of detection circuit layers being all electrically coupled to the at least one resistance layer;

a conductive base plate, located on the resistor-base plate, further including:

a main conductive plate body, having a coupling surface facing the main plate body; and an electricity-conductive layer, located above the coupling surface, extending along the extension direction, having a coverage area to shadow the plurality of detection circuit layers; and a separator member, located between the resistor-base plate and the conductive base plate for separating the plurality of detection circuit layers from the electricity-conductive layer, the separator member further including a central opening extending along the extension direction, the plurality of detection circuit layers and the electricity-conductive layer being located respective to the central opening;

wherein one of the main plate body and the main conductive plate body is a flexible-touch base plate;

wherein, while the flexible-touch base plate is depressed, part of the electricity-conductive layer is to pass the central opening and to further electrically couple at least of the plurality of the detection circuit layers.

5. The touch-type variable resistor structure of claim 4, wherein the plurality of detection circuit layers are expanded in an extension direction of detection circuit perpendicular to the extension direction.

6. The touch-type variable resistor structure of claim 4, wherein the resistance layer is formed as a pair of resistance layers, the two resistance layer being separated, the plurality of detection circuit layers further including a plurality of first detection circuit layers and a plurality of second detection circuit layers, the plurality of first detection circuit layers being electrically coupled to a first resistance layer of the two resistance layers, the plurality of second detection circuit layers being electrically coupled to a second resistance layer of the two resistance layers, the plurality of first detection circuits and the plurality of second detection circuits being arranged in a predetermined interval manner.

7. The touch-type variable resistor structure of claim 6, wherein the first resistance layer has a positive end and a negative end, and the second resistance layer also has its-own a positive end and a negative end, the positive end of the first resistance layer and the negative end of the second resistance layer being located at one side of the main plate body, the negative end of the first resistance layer and the positive end of the second resistance layer being located at another side of the main plate body.

8. The touch-type variable resistor structure of claim 4, wherein the resistor-base plate further includes at least one electrode set, the electrode set having a positive contact point and a negative contact point, the resistance layer having two ends to electrically couple the positive contact point and the negative contact point, respectively.

9. The touch-type variable resistor structure of claim 4, wherein the resistance layer is a carbon coating layer.

* * * * *